US008074436B2

(12) United States Patent
Hardee et al.

(10) Patent No.: US 8,074,436 B2
(45) Date of Patent: Dec. 13, 2011

(54) CUT, OIL AND FLAME RESISTANT GLOVE AND A METHOD THEREFOR

(75) Inventors: Fred Hardee, Asheville, NC (US); Gopinath Radhakrishnan, El Paso, TX (US); Marco Carrillo, Chihuahua (MX); Dave Narasimhan, Flemington, NJ (US); Cherilyn N. Nelson, Seneca, SC (US)

(73) Assignee: Ansell Healthcare Products LLC, Red Bank, NJ (US)

( * ) Notice: Subject to any disclaimer, the term of this patent is extended or adjusted under 35 U.S.C. 154(b) by 529 days.

(21) Appl. No.: 12/356,325

(22) Filed: Jan. 20, 2009

(65) Prior Publication Data

US 2009/0183296 A1 Jul. 23, 2009

Related U.S. Application Data

(60) Provisional application No. 61/022,841, filed on Jan. 23, 2008, provisional application No. 61/040,213, filed on Mar. 28, 2008.

(51) Int. Cl.
*D02G 3/18* (2006.01)

(52) U.S. Cl. ..... 57/224; 57/229

(58) Field of Classification Search ..... 57/5, 224, 57/229

See application file for complete search history.

(56) References Cited

U.S. PATENT DOCUMENTS 2,650,365 A 9/1953 Singer
3,689,613 A 9/1972 Talalay
4,016,714 A * 4/1977 Crandall et al. ..... 57/234
4,375,779 A * 3/1983 Fischer ..... 87/6
4,384,449 A 5/1983 Byrnes, Sr. et al.
4,454,611 A 6/1984 Tschirch et al.
4,470,251 A 9/1984 Bettcher
4,651,514 A 3/1987 Collett et al.
4,777,789 A 10/1988 Kolmes et al.
4,838,017 A 6/1989 Kolmes et al.
4,936,085 A 6/1990 Kolmes et al.
5,070,540 A 12/1991 Bettcher et al.
5,177,948 A 1/1993 Kolmes et al.
5,248,548 A 9/1993 Toon
(Continued)

OTHER PUBLICATIONS

PCT Search Report and Written Opinion in PCT/US2009/031637, dated Apr. 7, 2009, 14 pp.

*Primary Examiner* — Shaun R Hurley
(74) *Attorney, Agent, or Firm* — Moser Taboada

(57) ABSTRACT

A flexible cut resistant hydrocarbon flash fire resistant latex glove article is provided, having a flame resistant cut resistant liner and a flame resistant oil resistant polychloroprene polymeric latex coating. The knitted cut resistant fire resistant liner has is made from a composite yarn having a fiberglass core and optionally including a steel fiber. The core has a cushioning core sheath formed by ring-spinning of microdenier staple cut resistant fibers of, for example, para-aramid. and Staple modacrylic fibers can be included with the staple para-aramid fibers. Two wraps of continuous yarns of polyester, para-aramid, or both at a wrap density such that the wraps do not cover the core sheath in its entirety. In the absence of steel fiber, the cut resistant hydrocarbon flash fire resistant glove exhibits good electrical insulation characteristics even with sweat generated from hand preventing short circuit of electrical circuits. The glove is flexible due to the low denier of the composite yarn and is highly breathable especially when only the palm and fingers are coated with polychloroprene polymer.

27 Claims, 1 Drawing Sheet

U.S. PATENT DOCUMENTS 5,423,168 A 6/1995 Kolmes et al.
5,555,716 A * 9/1996 Dugan ..... 57/224
5,628,172 A 5/1997 Kolmes et al.
5,644,907 A 7/1997 Kolmes et al.
5,655,358 A 8/1997 Kolmes
5,822,791 A 10/1998 Baris
5,845,476 A 12/1998 Kolmes
5,965,223 A 10/1999 Andrews et al.
6,016,648 A 1/2000 Bettcher et al.
6,021,524 A 2/2000 Wu et al.
6,075,081 A 6/2000 Nile et al.
6,279,305 B1 8/2001 Hummel
6,341,483 B1 1/2002 Kolmes
6,347,409 B1 2/2002 Nile et al.
6,349,531 B1 2/2002 Kolmes et al.
6,352,666 B1 3/2002 Nile et al.
6,363,703 B1 4/2002 Kolmes
6,381,940 B1 5/2002 Kolmes et al.
6,467,251 B1 10/2002 Kolmes
6,701,703 B2 3/2004 Patrick
6,779,330 B1 8/2004 Andrews et al.
6,826,898 B1 12/2004 Hummel
6,915,667 B2 7/2005 Morita et al.
6,945,080 B2 9/2005 Maeda et al.
7,065,950 B2 6/2006 Zhu et al.
7,111,445 B2 9/2006 Threlkeld et al.
7,143,570 B2 12/2006 Piat
7,207,194 B2 4/2007 Miyamoto
7,469,526 B2 12/2008 Patrick et al.
2002/0011062 A1* 1/2002 Patrick ..... 57/210
2005/0086924 A1 4/2005 Kolmes
2007/0062173 A1 3/2007 Hummel
2007/0204381 A1 9/2007 Thompson et al.
2008/0199695 A1* 8/2008 Patrick et al. ..... 428/364
2008/0289312 A1 11/2008 Takada

* cited by examiner

CUT, OIL AND FLAME RESISTANT GLOVE AND A METHOD THEREFOR

CROSS-REFERENCE TO RELATED APPLICATIONS

This application claims priority to U.S. Provisional Patent Application Nos. 61/022,841 filed Jan. 23, 2008 and 61/040,213, filed Mar. 28, 2008, both of which are hereby incorporated by reference in their entireties.

TECHNICAL FIELD

Aspects of the invention relate to a medium weight glove that is flexible and protects workers from cuts and bruises while working in a petroleum oil-containing environment. The polymeric lining of the flexible protective glove is resistant to swelling and degradation in the oily environment and is also fire resistant, a requirement for gloves in a petroleum oil-containing environment. These oil resistant cut protecting gloves potentially need to have reinforcement liners that resist shorting of an electrical circuit.

BACKGROUND

Gloves are commonly used to protect hands in an industrial or household environment. These commonly used household or industrial protective gloves do not resist oil and are not commonly cut resistant. The gloves that may be used in tar sand or oil shale environments need to meet specific codes that require the gloves to be fire resistant. As an example, the national standard of Canada code CAN/CGSB-155.20-2000 details tests for workwear for protection against hydrocarbon flash fire. The code has three classes, type 1 covering single layer garments, type 2 covering multilayer garment and type 3 covering disposable garment.

Certain cut resistant fibers, knitted liners, coated gloves are known in the prior art. Fibers including steel fibers, fiberglass, para-aramid fibers (Kevlar®) and extended chain gel spun polyethylene fibers (Spectra®) are well known in the art. Of these fibers, generally only steel fibers, glass fibers and para-aramid fibers meet the Canada code CAN/CGSB-155.20-2000. Extended chain polyethylene Spectra® is not generally considered flame retardant due to the ability of a polyethylene fiber to catch fire. Non-cut resistant fibers that are typically used to wrap cut resistant fibers as disclosed in the prior art also have problems in meeting the Canada code CAN/CGSB-155.20-2000 fire resistance code. Polycotton and nylon 6 wrap fibers readily catch fire when exposed to a flame. However, polyester fibers char readily and prevent the propagation of the flame front. Nylon 6,6 also self-extinguishes a flame readily.

Generally, cut resistant liners are fabricated from cut resistant yarns. Cut resistant liners of the prior art typically contain steel fibers, glass fibers, para-aramid fibers (Kevlar®), gel spun extended chain polyethylene fibers (Spectra®). These yarns are constructed from one or more of these cut resistant fibers and may be twisted or wrapped with cotton, polyester, nylon and the like. For example, U.S. Pat. Nos. 4,777,789 and 4,838,017 to Kolmes et al. disclose cut resistant yarns with a wire core wrapped with nylon, aramid, extended chain polyethylene, cotton, wool, fiberglass, polyester, polycotton, asbestos. The wrappings of cotton, nylon, polyethylene will catch fire when exposed to flame. Further, these wrapped, cut resistant yarns with a wire in the core are subject to shorting electrical circuits. U.S. Pat. No. 4,651,514 to Collett discloses electrically nonconductive, abrasion and cut resistant yarns.

This electrically non-conductive, cut and abrasion resistant yarn is for use in the manufacture of protective coverings and includes a core of monofilament nylon having a diameter in the range of about 0.004 to 0.020 inches, a first wrap on the core of at least one strand of aramid fiber and a second wrap on the core of texturized nylon of two to eight ply construction. Since the yarn contains nylon monofilament yarn and textured nylon, it is not hydrocarbon flash fire resistant. U.S. Pat. Nos. 4,936,085 and 5,177,948 to Kolmes et al. disclose non metallic cut resistant yarns with a core that contains a fiberglass strand that is tightly wrapped with relatively large denier fiber strands in two layers wound in opposite directions so as to entirely cover the fiberglass containing inner core. As indicated in U.S. Pat. No. 5,177,948 the spacing between fibers in the wrapped fibers is small due to the large number of turns of wrappings used which is in the range of 8 to 12 turns per inch. The denier of the composite yarn produced is about 3500 in U.S. Pat. No. 4,936,085 and 2000 to 5000 in U.S. Pat. No. 5,177,948. Such yarns cannot be tightly knitted and produce thick knitted liners. If latex dipped gloves were made therefrom, they would not flexible. Use of polycotton nylon wrapping disqualifies these fibers for hydrocarbon flash fire applications. U.S. Pat. Nos. 5,628,172; 5,644,907 and 5,655,358; to Kolmes et al. disclose cut resistant yarns that are wrapped. These composite yarns contain extended chain polyethylene and polycotton, both components capable of being ignited and therefore are unsuited for hydrocarbon flash fire application. Some of the yarns contain metallic cut resistant fibers, which can short circuit electrical circuits. U.S. Pat. No. 5,845,476 to Kolmes discloses composite yarn with fiberglass core. The core of the composite yarn comprises one or more fiberglass strands that are wrapped with a sheath strand and a cover strand at a rate of 8 to 12 turns wound in opposite directions. The sheath strand and cover strand are made from extended chain polyethylene, aramid, nylon, and polyester, and due to the tight wrappings of a large denier sheath and cover strands the overall diameter of the composite yarn is large with a denier in the range of 1800 to 5000 even though the untwisted parallel fiberglass strands only have a total denier of 200 to 600, which means that the sheath strand and cover strand that completely cover the fiberglass strands and substantially add to the diameter of the composite yarn. This composite yarn is said to go through knitting machine needles without breakage of the fiberglass core, but due to its large denier only thick knitted liners with low stitch density per inch can be produced. When this knitted liner is dipped in latex, it only produces thick gloves with limited flexibility. U.S. Pat. Nos. 6,341,483 and 6,349,531 to Kolmes et al. disclose a multi-component yarn that has a non-metallic cut resistant core which may be extended chain polyethylene or aramid fiber air interlaced with polyester, nylon, acetate, rayon, and cotton. Fiberglass may be used as a third covering also air interlaced. Use of flammable fiber components such as polyethylene, nylon, acetate, rayon and cotton disqualifies this multi-component yarn as a hydrocarbon flash fire resistant garment. Wire-containing cut resistant fibers are disclosed in U.S. Pat. Nos. 6,363,703; 6,381,940; and 6,467,251, U.S. Patent Application Publication No. 2005/0086924 to Kolmes et al. disclose use of a wire in the cut resistant fiber and are therefore unsuited for electrical short prevention applications. In addition, these fibers contain flammable fibers including polyethylene fibers, cotton, nylon and the like and will not meet the hydrocarbon flash fire resistance requirements. U.S. Pat. No. 6,701,703 to Patrick discloses high performance yarns and method of manufacture. The yarn has a core with glass fibers that are stress-cracked and a metal fiber which is wrapped by a sheath of aramids, acrylics, melamines, modacrylics, polyesters, polypropylenes, nylons, cellulosics, silica, graphites, carbon fibers, high density polyethylene, polyamides, metals, polybenzimidazole, co-polymers. The sheath is not hydrocarbon flash fire resistant. U.S. Pat. No. 7,111,445 to Threlkeld et al. discloses a fire-resistant sewing yarn and the products made therefrom. This sewing yarn has a central core of elongatable fiber which is nylon or polyester, wrapped by fiberglass and the outer cover is nylon and polyester. Wrapping with fiberglass requires the fiberglass denier to be very small and therefore does not have cut resistance. The sewing yarn is intended to hold together after exposure to 1000° C. after a fire, when everything bums out except fiberglass portion of the sewing yarn. U.S. Pat. No. 7,143,570 to Piat discloses thread having properties of resistance to cutting. This thread consists of a core thread sheathed with a continuous filament. The core is a plurality of glass filaments and is wrapped by a continuous filament selected from polyamide, polyester, acrylic, cotton, polyethylene, polypropylene, and meta- and para-aramid. Since non-flame resistant fibers are possible in this thread, the thread may not be hydrocarbon flash fire resistant. Moreover, use of filaments of glass fibers does not provide high level of cut resistance. In U.S. Pat. No. 7,469,526 (Patrick), a heat and flame resistant sewing thread uses a core of glass filaments having an elongation of less than about four percent having a sheath of microdenier aramid fibers ring spun about the core. The ring spinning introduces twists in the fiberglass core while the ring spun aramid fibers have an opposite twist. When tension is applied to this composite thread, it elongates to about four percent due to the relaxation of twists in the fiberglass core and the ring spun aramid fibers. This composite is for use as a sewing thread and is unsuitable for use in a knitting machine since the ring spun aramid fibers surrounding the core could be readily stripped off.

U.S. Pat. No. 5,070,540 to Betcher discloses a protective garment. The protective garment has a knitted liner with stainless steel wires together with a synthetic non-aramid nylon fiber wrapped with two wraps of polyester fiber. The knitted liner is coated with a liquid impervious polymeric coating selected from natural latex, polyacrylates e.g. polyethyl acrylate, polybutadiene, styrene-butadiene copolymer, acrylonitrile-butadiene rubber and neoprene (polychloroprene). Since the core has a nylon fiber, and the polymeric coating may have non flame resistant polymers, the protective garment may not meet hydrocarbon flash fire resistance requirements. In addition, the presence of steel fiber will lead to short circuit of electrical circuits.

U.S. Pat. No. 5,822,791 to Baris discloses protective material and method. The base layer of the protective article has cut resistant fibers, which is joined to an intermediate layer of natural fibers joined in one or more locations. The intermediate layer is covered with a liquid impervious elastomeric layer, which never contacts the cut resistant base layer. The base layer may be a knitted liner with steel fiber or cut resistant liquid crystal polymer fiber wrapped with polyamide or polyester fiber. The elastomeric layer is indicated to be acrylonitrile rubber, acrylonitrile butadiene rubber, nitrile butadiene rubber, nitrile silicone rubber, polychloroprene, polyvinyl chloride, polyisoprene, Nomex or Viton. Since the cut resistant knitted liner has polyamide (nylon 6) and the intermediate layer has natural fibers, the protective material does not resist hydrocarbon flash flame.

U.S. Pat. No. 6,021,524 to Wu et al. discloses cut resistant polymeric films. The polymeric matrix of the film comprises a plurality of cut resistant fibers in a middle layer and is indicated to be usable for medical or industrial gloves. The middle layer is not a knitted liner and contains a three-dimensional network of chopped fibers of glass fibers, steel fibers, aramid fibers and particle filled fibers. The polymeric matrix is made from natural rubber, polychloroprene, styrene-isoprene-styrene block copolymers, styrene-ethylene butylene-styrene block copolymers, styrene-butadiene-styrene block copolymers, polyurethane, polyurea, nitrile rubber, vinyl chloride based polymers. Not all of these chopped fibers or polymeric matrices disclosed will pass the hydrocarbon flash fire resistance test. U.S. Pat. Nos. 6,075,081; 6,347,409; and 6,352,666 to Nile et al. disclose manufacture of rubber articles. Polychloroprene latex rubber articles made from a polychloroprene aqueous latex and being coated with a polypropylene wax emulsion are provided. The rubber article does not have a knitted liner and therefore is not a cut resistant latex article.

When the latex layer used is made porous in order to provide breathability, the resulting thickness of the porous latex layer is generally greater resulting in an awkward feeling glove with limited touch sensitivity. For equivalent wear resistance, the foam layer must be thicker than a non-foamed layer. A number of prior art patents address gloves and their forming methods using a relatively thick knitted liner and a thick coating of latex layers. The combination of a thick knitted liner and a thick foamed latex layer do not result in a small overall glove thickness and the glove product does not provide flexibility and easy mobility of fingers and hand.

The knitting technology of V flat bed machines have improved significantly in the past few years. Knitting needles in the knitting machine were essentially a hook with a swingable latch that captures a yarn that is being knitted, but this knitted loop cannot be held or transferred back or combined with a previously knitted loop. U.S. Pat. No. 6,915,667 to Morita, et al. discloses a composite needle of knitting machine. This composite needle comprises a needle body having at a tip end a hook, a slider formed by superposing two blades, wherein the composite needle of the knitting machine is formed such that a blade groove provided in the needle body supports the blades of the slider when the needle body and the slider can separately slide in forward and backward directions. This slider acts as a latch securing the yarn being knitted and can transfer the yarn loop for pushing the loop backwards, holding the loop or transfer back to a previously knitted loop providing automatic knitting of complex patterns as detailed in the Shima Seiki web page http://www.shinaseiki.co.jp/product_knite/knite.html. This type of composite needle is available in Shima Seiki commercially available whole garment knitting machines SWG021 and SWG-FIRST machines. The SWG-FIRST machines provides gaugeless knitting, meaning that the number of needles may be changed on the fly under computer control seamlessly by using split stitch technology, as detailed in U.S. Pat. No. 7,207,194 to Miyamoto entitled "Weft knitting machine with movable yarn guide member." These machines are ideally suited for changing the reinforcement geometry of the knitted location at specific locations of the liner. A knitting needle size needs to be selected according to the denier size of a yarn and correspondingly, a knit pattern is generated in a standard knitting machine. For example, a 10 gauge needle produces typically 10 knits per inch.

Accordingly, there is a need in the art for composite yarn that has fire resistant materials that has a relatively low denier and is capable of being used in a commercial knitting machine without damage to a fiberglass containing core of the composite yarn even when the composite yarn is passed through knitting machine needles at high speed. The smaller overall diameter of the composite yarn will result in flexible cut resistant knitted liner. Accordingly, there is a need in the art for a flexible glove that has hydrocarbon flash fire resistant yarns in a cut resistant liner and is coated with a hydrocarbon flash fire resistant liquid impervious polymer for use in petroleum oil-environment. The cut resistance is required since handling sharp objects with a slippery oil film on a glove results in tool slippage and can result in cuts and bruises. The oil contamination contaminates the wound and prevents rapid healing of the wound. Moreover, the cut resistant liner may not contain steel fibers or electrically conductive material such as carbon fibers especially when electrical circuits are present. These electrically conductive fibers may heat rapidly creating a burn and may even initiate a fire and at the same time short circuit electrical components.

SUMMARY

The gloves that may be used in petroleum oil-environments need to meet specific codes that require the gloves to be fire resistant. As an example, the national standard of Canada code CAN/CGSB-155.20-2000 details tests for workwear for protection against hydrocarbon flash fire. The code has three classes, type 1 covering single layer garments, type 2 covering multilayer garment and type 3 covering disposable garment. The garment is placed at a distance of 20 mm from the tip of a burner flame for no more than 12 seconds when the edge of the garment is placed at an angle of 30 degrees. Damage present should be no more than 100 mm in any direction and there shall be no melting or dripping. The fibers used should be inherently flame resistant and should not melt below 260° C. Cut resistance is extremely important while working in this hazardous environment, for example, fixing machinery wherein sharp tools are used and the presence of a slippery oil film makes tool handling more difficult. Any cut or injury results in oil contamination reducing the healing rate of a wound. While the prior art details a number of approaches to produce a cut resistant liner that is coated with one or more layers of a polymeric latex coating forming gloves, these gloves do not meet flash flame fire resistance dictated by the code requiring use of inherently flame resistant fibers or fibers that do not melt below 260° C. In addition, the polymeric coating used also does not meet the flash flame fire resistance criteria. Of the cut resistant fibers available, only steel fibers, fiberglass and para-aramid (Kevlar®) fibers meet the flame resistance criteria. Non cut resistant fiber such as polyester, preferably polyethylene terephthalate, polypropylene terephthalate or polybutylene terephthalate, also meets this fire resistance criteria. Nylon 6,6 is indicted to have a melting point of about 250° C. and is indicated to be self extinguishing of a flame. Cut resistant fiber such as extended chain gel spun polyethylene fibers (Spectra®) are reported to have a melting range of 160° C. to 250° C. depending on molecular weight, but the fiber itself is not flame resistant and catches fire. Similarly, nylon 6 fibers, polycotton and other fibers also are not fire resistant.

The present invention provides a cut resistant fire resistant composite yarn comprising a core of one or more fiberglass strands, each strand can comprise a multitude of glass fibers as desired. The fiberglass strands are ring spun with a cushioning covering, also referred to as a core sheath, that contains a ring spun layer of aramid staple fibers that are held together by friction without use of any glue. Glues typically used to adhere stable fibers are recognized to be ignitable and thus are unsuited for use with fire resistant composite yarns. During ring spinning, a twist is incorporated into the fiberglass core and the core sheath substantially covers the fiberglass core. One or more outer wraps around the core sheath prevent it from unraveling when the composite yarn passes at high speed through the needles of a knitting machine. The one or more outer wraps are fire resistant polyester and/or aramid continuous yarns wound in opposite directions to each other at a very low turns per inch, typically in the range of 2 to 3, thereby not completely covering the core sheath, which is therefore clearly visible. The wrap yarns may be of any structure desired, for example, they can be single continuous yarns and/or yarns spun from staple fibers that are held together by friction imparted during fiber spinning process. During the knitting process, these two wrappings permit easy delivery of the yarn through a knitting machine and prevent unraveling of the core sheath from the fiberglass core. The cushioning feature of the core sheath prevents sharp bends in the fiberglass core during high-speed transit through the knitting machine thereby preventing mechanical damage to the fiberglass core. Since the composite yarn is cut resistant with no material of construction that can degrade in a fire environment, the composite yarn of the present invention is suited for construction of a glove that is usable in a tar sand field meeting Canadian fire code. Since the yarn has a lower denier than what is available from prior art, the knitted liner may be knit with a 10 or a 13 gauge needle creating a highly flexible liner. A glove dipped in latex is durable with a lower level of overall thickness, higher level of flexibility in combination with the much needed properties of oil resistance, fire resistant properties. If the composite yarn used does not have any metallic fibers, the glove also eliminates electrical shock hazards.

The glove of the subject invention includes cut resistant fibers, including fiberglass and para-aramid fibers wrapped with polyester fibers and/or nylon 6,6 fibers and/or additional para-aramid fibers to create a cut resistant liner that is hydrocarbon flash fire resistant. The cut resistant fiber may include steel fibers for applications where electrical short circuit protection is not needed. Inclusion of steel fibers in the core together with glass fiber increases cut resistance to a great extent due to the strain hardening of steel fibers when subjected to plastic deformation at the cutting knife edge. In one or more embodiments, the cut resistant knitted liner is coated on the palm side with polychloroprene from an aqueous latex emulsion and is also flame retardant. A chlorine containing polymer such as polychloroprene (Neoprene™) releases chlorine at the flame-polychloroprene interface and the released chlorine displaces oxygen due to its increased density extinguishing the fire and limiting damage to the glove when exposed to the flame. Polychloroprene latex is highly resistant to oils and does not swell or become sticky. Steel fibers generally do not provide adequate electrical insulation when cut potentially producing a short circuit in electrical the circuits and is used in the cut resistant core only when the oil environment application does not require short circuit protection.

The cut resistance of a glass fiber is a strong function of its overall diameter and may have plurality of glass fibers forming a bundle. Larger overall diameter fibers are more difficult to cut than small diameter glass fibers. However, the flexibility of large diameter glass fibers is limited and may easily break when subjected to a sharp bend as is experienced in a knitting machine. The glass fibers need to be cushioned by a ring spun core sheath in order to limit their radius of curvature, and this cushioning increases the overall cut resistance of the yarn. The core of cut resistant fiber may further include a para-aramid (Kevlar®) fire resistant fiber. An exemplary cut resistant composite yarn that passes the Canada code CAN/CGSB-155.20-2000 is FR109G(MR). The yarn has a fiberglass core 1 ply 1/11 EC5. The fiberglass core is ring spun with a core sheath of 60% para-aramid 40% modacrylic and further wrapped with 2 wraps of polyester. The cut resistant FR109G(MR) yarn denier is 1700 or 1 ply 3.15 Cotton count size. Denier is defined as number of grams of a yarn having a length of 9000 meters. A second exemplary embodiment of a cut resistant composite yarn that passes the Canada code CAN/CGSB-155.20-2000 is PGTS 10 KEV with a core of two fiberglass strands each 100 denier having a core sheath that has staple fibers of 60% Kevlar and 40% modacrylic with a bottom wrap of Kevlar 25 and a top wrap of Kevlar 39, wraps wound in a opposite direction with 2 to 3 turns per inch. The composite yarn has approximately 14/7% glass, 11.5% modacrylic and 73% Kevlar. The overall denier of this composite yarn is 1384. A third exemplary embodiment of a cut resistant composite yarn that passes the Canada code CAN/CGSB-155.20-2000 is PGTS 13 KEV with a core of two fiberglass strands each 100 denier having a core sheath that has staple fibers of 60% Kevlar and 40% modacrylic with a bottom wrap of Kevlar 25 and a top wrap of Kevlar 25, wraps wound in a opposite direction with 2 to 3 turns per inch. The composite yarn has approximately 20% glass, 8% modacrylic and 72% Kevlar. The overall denier of this composite yarn is 980. This yarn may be knitted with a Shima Seiki flat bed knitting machine with a needle size of 10 or 13 which produces 10 knitted stitches per inch or 13 knit stitches per inch, respectively. Depending on cut-resistant needs, a finer yarn may be used of similar construction using, for example, 15 or 18 gauge needles. Typically the knitting machine is used to knit the liner in the shape of a human hand. The knitted liner using this fire resistant cut resistant yarn has a thickness of approximately 0.74 mm or 0.029 inches. In spite of the increased thickness of the knitted liner, this medium weight liner is highly flexible due to the low denier of the composite yarn and the presence of cushioning core sheath.

Another variant of the second and third embodiments of the exemplary cut resistant yarn that passes the Canada code CAN/CGSB-155.20-2000 is one having a fiberglass core 2 ply 1/11 EC5 (total denier of 200). The fiberglass core is cushioned with a ring-spun wrap of 60% para aramid 40% modacrylic staple fibers and further wrapped with 2 outer wraps of para-aramid. The deniers of the resulting ring-spun wrap and para-aramid wraps can be varied to meet users' needs. The staple fibers have microdeniers in the range of 0.5 to 2.5, specifically, 1.0 to 2.0 denier. The ring-spun wrap in its entirety can have a denier in the range of 200-700. The outer para-aramid wraps, can have the same or different denier in the range of 200-400, for example, 200, 225, 250, 275, 300 325, 350, 375, or even 400. This cut resistant yarn has a denier in the range of approximately 900 to 1800 (900, 980, 1030, 1080, 1180, 1280, or 1380, 1400, 1450, 1500, 1550, 1600, 1650, 1700, 1750, or even 1800).

In a second version of a cut resistant flame resistant yarn, a 4 mil steel wire is inserted in the core of the yarn together with glass fiber and para-aramid (Kevlar®) yarn and is wrapped in the same manner as the first yarn. The denier of the yarn is similar and the knitted liner has a similar thickness. This yarn also passes the Canada code CAN/CGSB-155.20-2000 hydrocarbon flash fire resistance test. The cut resistance of the yarn is significantly improved due to the presence of the steel wire in the core. Cut resistant yarns of the first or second type may have a denier of 1800 or less, for example, in the range of 1400 to 1800.

The cut resistant knitted liner using either of the two fibers stated above is dressed on a ceramic or metallic former that has the shape of a human hand. The cut resistant knitted liner is first coated with a calcium nitrate coagulant. The palm and finger portions are then dipped into an aqueous polychloroprene latex emulsion. The coagulant destabilizes the aqueous latex emulsion allowing the formation of a coagulated polychloroprene latex film covering the palm and finger portions of the glove. Since there are large interstices present between the yarns in the knitted liner, it is desirable to prevent the aqueous polychloroprene latex from "striking-through" to the hand-contacting side of the knitted liner. The polychloroprene latex tends to irritate the hand and it is desirable to avoid contact between the polychloroprene latex and a hand.

Various methods are available to limit the "strike-through" of the polychloroprene latex emulsion into the interstices of the cut resistant knitted liner. One technique is to limit the depth of penetration of the former that is dressed with the cut resistant liner into the aqueous polychloroprene latex bath. This can be conveniently accomplished by using a robot machine that articulates the movement of the former into the latex bath with a curved movement. The second approach is to limit the penetration of the aqueous polychloroprene latex into the interstices of the cut resistant knitted liner by increasing the viscosity of the aqueous polychloroprene latex. This is conveniently done by use of thickeners added to the aqueous polychloroprene latex emulsion bath. Another approach is to block the interstices in the cut resistant knitted liner with wax solvent based polyurethane or other water soluble blocking agent such as PVA prior to dipping in the coagulant and then into the aqueous latex emulsion. The wax blockage is removed by washing in warm water and water soluble blocking agent is similarly removed by washing.

The medium weight glove is formed, the glove being flexible due to the low denier of the composite yarn used along with the cushioning feature of the core sheath. The glove highly breathable especially when only the palm and fingers are coated with polychloroprene polymer. While one embodiment of the invention is to coat only the palm and finger portions of the glove, in other embodiments, it may be desirable that the entire glove is coated with polychloroprene coating. The advantage of this complete coverage is it provides insulation against temperature exposure, but at the expense of flexibility of the glove especially at the back portion of the hand. The overall thickness of the polychloroprene coated glove is typically 1.3 mm or 0.053 inches.

Embodiments of the polychloroprene-coated cut resistant gloves, one embodiment having fiberglass and another embodiment having steel, are tested for electrical conductivity performance. The steel wire-containing gloves have poor performance especially when the polychloroprene layer is cut and a sharp object contacts the cut resistant liner. The steel fibers conductivity is assisted by any sweat that is present on the hand, which is conductive due to salt content.

In one or more embodiments, the glove liners contain, further to the cut resistant yarn, elastic and/or heat fusible yarns used for finishing edges, forming cuffs, and the like.

DETAILED DESCRIPTION

Figure 1:
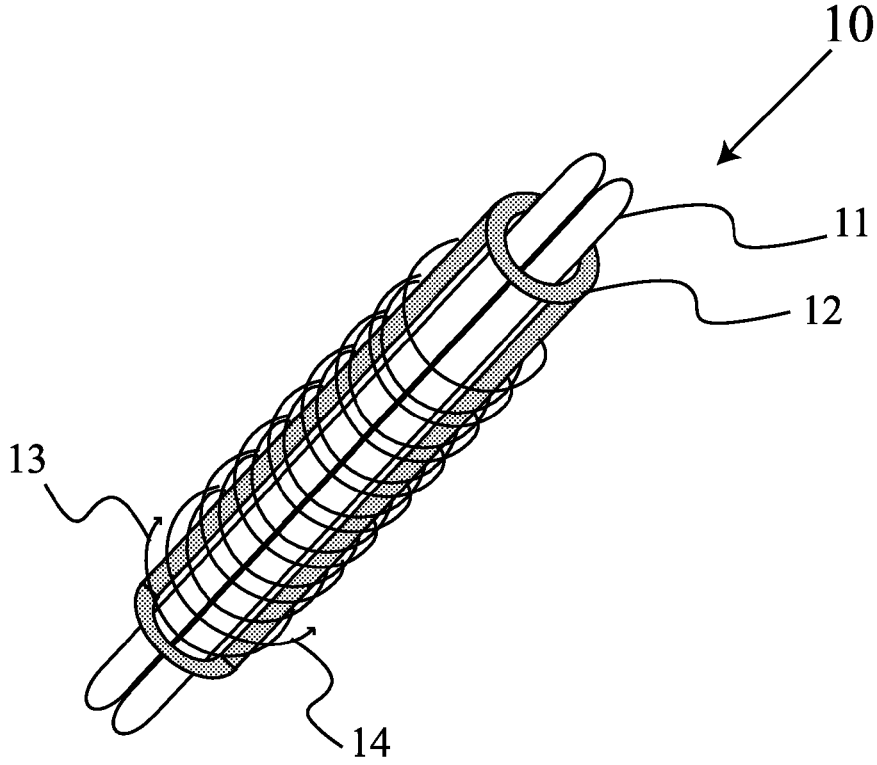
FIG. 1 shows at 10 a schematic diagram of a composite yarn of the present invention. The composite yarn has a central core 11 with two fiberglass bundles composed of a multitude of small diameter glass filaments within each bundle. Surrounding this core is a core sheath 12, which is a cushion layer formed by ring spinning of staple fibers of 60% Kevlar and 40% Modacylic. The core sheath is surrounded by two wrappings of para-aramid continuous yarns 13 and 14 wound in opposite direction at a line pitch of 2 to 3 turns per inch. The wrappings do not completely cover the core sheath and their main function is to prevent the stripping off the core sheath when the composite yarn is passed through knitting machine needles at high speed.
Figure 2:
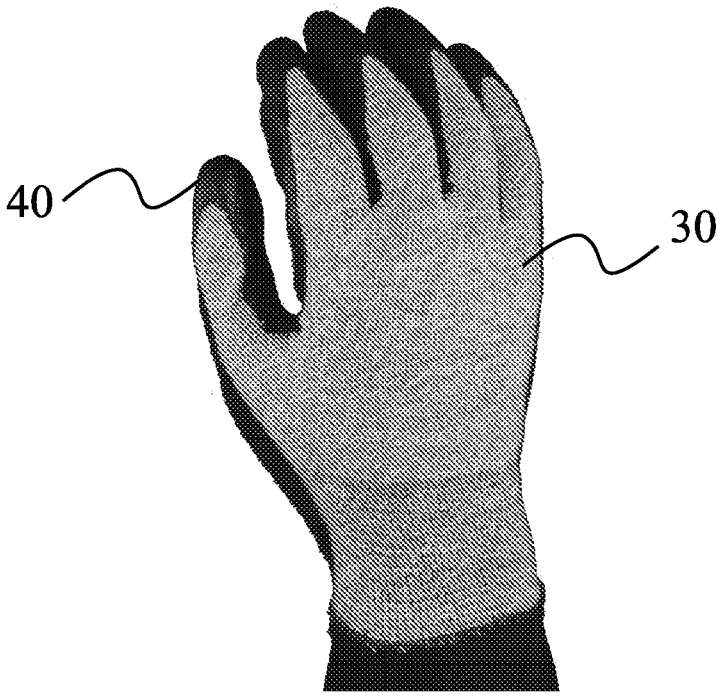
FIG. 2 shows the back side of a cut resistant and non-conducting glove according to an embodiment of the present invention. The knitted liner 30 has a polychloroprene coating 40 on its palm side where the fingers are partially coated.

Knitted glove liners are currently made using flat knitting machines that use a number of needles in the form of a needle array and one or more yarns to knit the glove liner. In general, eight basic components can be used to comprise the glove. These eight components include one component for each of the five fingers, two components for the palm including an upper section and a lower section; and one component for the wrist area. All of these sections are cylinders or conical sections that join to each other fashioning the general anatomical shape of a hand. Conventional knitting processes use a knitting machine to knit each of these areas in a particular sequence, generally one finger at a time, beginning with the pinky finger and continuing on through the ring finger and middle finger to the forefinger. After each finger is knitted using only selected needles in the needle array, the knitting process for this finger is stopped and yarn is cut and bound. The knitted finger is held by holders, weighted down by sinkers. The next finger is knit sequentially one at a time using a different set of needles in the needle array. When all the four fingers are knitted in this fashion, the knitting machine picks up the stitches of previously knit four fingers that are held by he holders and then knits the upper section of the palm. The method of knitting individual fingers and picking stitches to knit the upper palm selection with better fitting crotches that are well fitted is discussed in U.S. Pat. No. 6,945,080 by Maeda, et al. After knitting an appropriate length of upper palm, the thumb portion is initiated using a separate set of needles in the needle array and the lower section of the palm is knit using all the needles in the needle array. Finally, the knitting machine knits the wrist component to the desired length.

The cut resistant, fire resistant composite yarn of the present invention has a core of one or more fiberglass yarns, that can optionally contain a para-aramid (Kevlar®) yarn, the core being cushioned with ring spun with a core sheath layer of 60% para aramid 40% modacrylic followed by two wraps of continuous polyester or continuous aramid yarns wound in opposite directions. The polyester may be fire resistant as a result of its manufacture or treatment. The core may also contain a steel fiber where the cut resistant yarn does not have to meet electrical short circuit resistance. The yarn is knitted in the shape of a human hand using a flat bed knitting machine using 10 or 13 gauge needles. A 10 gauge needle produces a knitted liner with 10 knit stitches per inch while a 13 gauge needle creates a knitted liner with 13 knit stitches per inch. The closer packing of yarns in the 13 gauge knitted liner means that the knitted liner will be thicker with smaller spaces between the individual yarns forming the knitted liner. The average thickness of the liner with a core that contains fiberglass fibers that passed the Canada code CAN/CGSB-155.20-2000 hydrocarbon flash fire resistance test had an average liner thickness of approximately 0.74 mm or 0.029 inches.

Table 1 shown below details the flame resistance test conducted on a knitted liner according to an embodiment of the invention. The CAN/CGGB-155-20-2000 paragraph 7.1 details procedures for flame resistance test using edge ignition. Five specimens in each direction (80 mm×200 mm) were cut, dried at 105° C. for one hour and cooled in a dessicator. Each specimen is mounted on a specified pin frame and the prescribed ignition flame is applied to the fabric edge for a period of 12 seconds. Afterflame flame retention times and damaged lengths in the fabric are recorded in Table 1.

TABLE 1

| Specimen No: | Damaged Length (mm) | After Flame Time (s) | Molten drops (Y/N) |
|---|---|---|---|
| 1 | 21 | 0 | No |
| 2 | 16 | 0 | No |
| 3 | 10 | 0 | No |
| 4 | 15 | 0 | No |
| Specification | <100 | <2.0 | None |

When this knitted liner is coated with a polychloroprene latex layer the average thickness of the glove is approximately 1.34 mm or 0.053 inches. The polychloroprene latex coating thickness is approximately 0.6 mm or 0.024 inches. A typical glove may have a thickness of approximately 1.1 mm to 1.5 mm.

General ingredients of an exemplary coagulant composition include calcium nitrate and a surfactant. Surfactants include but are not limited to FreeSil N, Surfynol 465 (ethoxylated acetylenic diol), Emulvin W (aromatic polyglycol ether). Water is typically part of the coagulant composition, but alcohols or other solvents can be used as desired.

For the aqueous latex composition, a chlorine-containing latex is used, for example, neoprene latex (polychloroprene latex). Further ingredients include, but are not limited to, zinc oxide, sulfur, Wingstay L (Phenol, 4-methyl-,reaction product with dicyclopentadiene and isobutylene, Butylated reaction product of p-cresol and dicyclopentadiene), Butyl Zimate (Sodium Di Butyl dithiocarbamate), Darvan #1 (Sodium salt of condensed sulfonated naphthalene), sodium hydroxide, potassium ricinoleate, a colorant, Darvan WAQ (Sodium lauryl sulfate and water), and thickeners. Thickeners include, but are not limited to, MHPC 50 (Methylhydroxylpropylcellulose) and Acrysol G 111 (polyacrylate solution). Colorants can include Aquablack G (Carbon black 6-60% by weight, Water 35-94% by weight, and optional surfactants 0-15% by weight) and/or Flint P016 High Strength Orange. Other optional ingredients include Foamkill (hydrotreated petroleum hydrocarbon).

The typical dip process is illustrated in the Table 2 shown below.

TABLE 2

| | |
|---|---|
| 1 | Mount Liners on Molds |
| 2 | Dip front part of the loaded mold into coagulant solution |
| 3 | Drain, Turn Up and dry |
| 4 | Dip in Neoprene Latex compound |
| 5 | Drain, Turn Up and air dry |
| 6 | Oven Dry |
| 7 | Oven Cure |
| 8 | Strip dipped liners from the mold |
| 9 | Proceed to QA inspection, stamp and packing |

Polycholorpene latex dipped knitted liners were subjected to a flame test. Table 3 shows the results of the flame resistance test conducted on a neoprene latex coated knitted liner. The CAN/CGGB-155-20-2000 paragraph 7.1 details procedures for flame resistance test using edge ignition. Five specimens in each direction (80 mm×200 mm) were cut, dried at 105° C. for one hour and cooled in a dessicator. Each specimen is mounted on a specified pin frame and the prescribed ignition flame is applied to the fabric edge for a period of 12 seconds. Afterflame flame retention times and damaged lengths in the fabric are recorded in Table 3.

TABLE 3

| Specimen No: | Damaged Length (mm) | After Flame Time (s) | Molten drops (Y/N) |
|---|---|---|---|
| 846-1 | 23 | 0 | No |
| 846-2 | 21 | 0 | No |
| 846-3 | 14 | 0 | No |
| 846-4 | 16 | 0 | No |
| 846-5 | 16 | 0 | No |
| 846-7 | 48 | 0 | No |
| 846-8 | 42 | 0 | No |
| 846-9 | 53 | 0.5 | No |
| 846-10 | 49 | 1.1 | No |
| Specification | <100 | <2.0 | None |

Having thus described various aspects of the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A cut, oil, fire resistant composite yarn free of ignitable fibers comprising:

a) a core of one or more fiberglass strands;

b) a cushioning core sheath of cut resistant staple microdenier fibers held together by friction between fibers during ring spinning of said core sheath, wherein the staple fibers comprise para-aramid fibers;

c) said core sheath surrounded by a one or more of a bottom wrap and a top wrap of fire resistant yarns wound in opposite directions such that said core sheath is not covered in its entirety;

whereby said fiberglass strands are prevented from breakage due to sharp bends in a knitting machine by the cushioning core sheath;

whereby said one or more bottom and top wraps prevent unraveling of said core sheath during passage of the composite yarn through a knitting machine.

2. The cut, oil, fire resistant composite yarn of claim 1 wherein said core additionally comprises fibers selected from the group consisting of steel fibers and para-aramid fibers.

3. The cut, oil, fire resistant composite yarn of claim 1 wherein said core sheath comprises para-aramid and modacrylic microdenier staple fibers.

4. The cut, oil, fire resistant composite yarn of claim 1 wherein said core sheath comprises 60% para-aramid and 40% modacrylic.

5. The cut, oil, fire resistant composite yarn of claim 1 wherein said one or more bottom and top wraps comprise continuous yarns of polyester, para-aramid, or both.

6. The cut, oil, fire resistant composite yarn of claim 1 wherein said one or more bottom and top wraps are each wound at 2 to 3 turns per inch.

7. The cut, oil, fire resistant composite yarn of claim 1 comprising by weight: 15-25% fiberglass, 5-11% modacrylic, and 67-77% para-aramid.

8. A flexible, cut, oil, fire resistant glove comprising:

a) a cut, oil, fire resistant knitted liner having a plurality of stitches made from a composite fire resistant yarn free of ignitable fibers;

b) said composite yarn having a core comprising fiberglass cushioned by a core sheath of ring-spun cut resistant staple microdenier fibers and said core sheath wrapped with one or more bottom and top wraps comprising polyester, para-aramid, or both, wherein the staple fibers comprise para-aramid fibers;

c) said knitted liner being coated with a fire resistant polymeric latex coating selected from chlorine-containing polymers.

9. The glove of claim 8, wherein the composite fire resistant yarn has a denier in the range of 900 to 1800.

10. The glove of claim 8, wherein the fiberglass has a denier in the range of 200-900, the staple cut resistant fibers comprise para-aramid and mod-acrylic, and said one or more bottom and top wrap strands wrapped in opposite directions relative to each other and both comprise para-aramid.

11. The glove of claim 8, wherein the yarn is free of wire, thereby providing an electrically non-conductive glove.

12. A flexible, cut, oil, fire resistant, non-conducting glove, comprising:

a cut resistant knitted liner having a plurality of stitches made from a composite fire resistant yarn having a total denier in the range of 900-1800;

said yarn comprising: a core comprising fiberglass, a cushioning core sheath of staple cut resistant microdenier fibers ring-spun by having a denier per fiber in the range of 0.5 to 2.5 denier, the staple fibers consisting essentially of para-aramid and modacrylic, and one or more bottom and top wraps comprise para-aramid, polyester, or both; and a polymeric polychloroprene latex coating adhered to the knitted liner;

whereby the combination of cut resistant liner in combination with the polychloroprene polymeric latex coating provides a glove that resists hydrocarbon flash fires for use in an oily environment; and whereby the combination of cut resistant liner in combination with the polychloroprene polymeric latex coating provides resistance against electrical shorting.

13. The glove of claim 12, wherein the one or more bottom and top wraps both comprise para-aramid fibers.

14. The glove of claim 12, wherein a skin-contacting surface of the knitted liner is substantially free of the polymeric polychloroprene latex coating.

15. The glove of claim 12, wherein the skin-contacting surface of the knitted liner is approximately 75% or more free of the polymeric polychloroprene latex coating.

16. The glove of claim 12, wherein the stitches are formed by a 10-gauge needle.

17. The glove of claim 12, wherein the stitches are formed by a 13-gauge needle.

18. The glove of claim 12, wherein the polychloroprene latex coating covers a palm section and a plurality of finger sections of the glove.

19. The glove of claim 12, wherein the polychloroprene latex coating covers a palm section and a back section of the glove.

20. The glove of claim 12, wherein the glove has a thickness in a range of from approximately 1.1 to approximately 1.5 mm.

21. The glove of claim 12, wherein the staple fibers comprise para-aramid in an amount of 60% by weight and modacrylic in an amount of 40% by weight.

22. A process for making a flexible cut, oil, fire resistant glove, comprising:

providing a glove-shaped cut resistant knitted liner having a plurality of stitches made from a composite fire resistant yarn having a core comprising fiberglass cushioned by staple cut resistant microdenier fibers ring-spun and one more bottom and top wraps comprising polyester, para-aramid, or both, the yarn being free of ignitable fibers; and adhering a polymeric polychloroprene latex coating to the knitted liner, wherein the staple fibers comprise para-aramid fibers.

23. The process of claim 22 comprising:

a. creating a glove shaped knitted liner knitted with the composite fire resistant yarn having a total denier in the range of 900 to 1800;

b. placing the knitted liner on a hand shaped ceramic or metallic former;

c. dipping the former and the knitted cut resistant fire resistant liner in a coagulant solution;

d. withdrawing the former and the coagulant coated knitted liner and drying the coagulant coating;

e. dipping the former and the coagulant coated liner into a tank containing an aqueous polychloroprene polymeric latex emulsion so that the polymeric polychloroprene latex destabilizes locally surrounding the knitted liner and forms a coagulated polychloroprene latex layer;

f. withdrawing the former and the knitted liner coated with gelled or coagulated polychloroprene polymer latex coating; and g. heating the former and the knitted liner coated with gelled or coagulated polychloroprene polymer latex coating to a temperature to vulcanize the polychloroprene latex coating to form a cured glove with cut resistant fire resistant knitted liner adhered to polychloroprene polymer latex cured coating.

24. The process of claim 23, wherein the step of creating the glove-shaped cut resistant fire resistant knitted liner includes using a knitting machine with a 10-gauge needle.

25. The process of claim 23, wherein the step of creating the glove-shaped cut resistant fire resistant knitted liner includes using a knitting machine with a 13-gauge needle.

26. The process of claim 23, wherein the dipping depth of the former and the coagulant coated cut resistant knitted liner into a tank containing the aqueous polychloroprene polymeric latex emulsion is in a range of from approximately 0.2 cm to approximately 5 cm.

27. A method of working in a tar or petroleum oil-containing environment comprising wearing a cut, oil, fire resistant, non-conducting glove comprising a knitted liner made from a composite fire resistant yarn having a core comprising fiberglass cushioned by a core sheath of staple cut resistant microdenier fibers ring-spun and one more bottom and top wraps comprising polyester, para-aramid, or both, the yarn being free of ignitable fibers; and a polymeric polychloroprene latex coating adhered to the knitted liner; wherein the glove resists hydrocarbon flash fires, wherein the staple fibers comprise para-aramid fibers.

* * * * *